US006263807B1

(12) United States Patent
Fox et al.

(10) Patent No.: US 6,263,807 B1
(45) Date of Patent: Jul. 24, 2001

(54) REINFORCED PLASTIC PALLET

(75) Inventors: Murray J. Fox, No. Grosvenordale, CT (US); Anthony E. Conte, Dix Hills, NY (US)

(73) Assignee: IR Operating Corporation, Webster, MA (US)

( * ) Notice: Subject to any disclaimer, the term of this patent is extended or adjusted under 35 U.S.C. 154(b) by 0 days.

(21) Appl. No.: 09/455,062

(22) Filed: Dec. 6, 1999

(51) Int. Cl.[7] ..... B65D 19/38
(52) U.S. Cl. ..... 108/57.25; 108/54.1; 108/56.1
(58) Field of Search ..... 108/57.25, 57.26, 108/901, 902, 51.11, 54.1, 56.1, 57.28

(56) References Cited

U.S. PATENT DOCUMENTS

| | | | | |
|---|---|---|---|---|
| 3,059,887 | | 10/1962 | Ward . | |
| 3,093,216 | | 6/1963 | Dunham . | |
| 3,561,374 | | 2/1971 | Honderich . | |
| 3,592,145 | | 7/1971 | Petry . | |
| 3,824,933 | * | 7/1974 | Lind | 108/902 X |
| 3,938,448 | * | 2/1976 | Nishitani et al. | 108/57.26 |
| 5,007,352 | * | 4/1991 | Calkoen | 108/902 X |
| 5,117,762 | * | 6/1992 | Shuert | 108/57.25 |
| 5,320,048 | | 6/1994 | Feiner . | |
| 5,404,829 | * | 4/1995 | Shuert | 108/57.26 |
| 5,413,052 | * | 5/1995 | Breezer et al. | 108/57.25 X |
| 5,778,801 | | 7/1998 | Delacour . | |
| 5,791,262 | * | 8/1998 | Knight et al. | 108/57.25 |
| 5,845,588 | * | 12/1998 | Gronnevik | 108/57.25 X |
| 5,894,803 | * | 4/1999 | Kuga | 108/57.25 X |
| 6,006,677 | * | 12/1999 | Apps et al. | 108/57.25 |
| 6,029,583 | * | 2/2000 | LeTrudet | 108/57.25 |
| 6,123,032 | * | 9/2000 | Ohanesian | 108/901 X |
| 6,125,770 | * | 10/2000 | Brandenberg | 108/57.25 |

* cited by examiner

*Primary Examiner*—Jose V. Chen
(74) *Attorney, Agent, or Firm*—James L. Jackson, Esq.; Mayor, Day, Caldwell & Keeton

(57) ABSTRACT

A reinforced plastic pallet having a plurality of pallet sections each composed of plastic material and having interlocking elements defined by side walls of the pallet sections. At least two of the pallet sections define front and rear pallet edges and each have at least one reinforcing receptacle located adjacent the front and rear pallet edges. At least two elongate reinforcing elements are located within the reinforcing receptacles and are oriented for reinforcing the front and rear pallet edges to minimize bending thereof when the front and rear pallet edges are resting on a rack and under load. The pallet sections are of generally tubular configuration having planar upper and lower walls and parallel side walls. The side walls define dove-tail or other interlocking connectors for securing the pallet sections in immovable assembly. Additionally the interlocking connections of the side walls may be secured by cement, bonding agent or heat welded and the elongate reinforcing elements may be retained within the reinforcing receptacles by cement or bonding material. The interlocking connections may also be secured by mechanical fasteners.

16 Claims, 2 Drawing Sheets

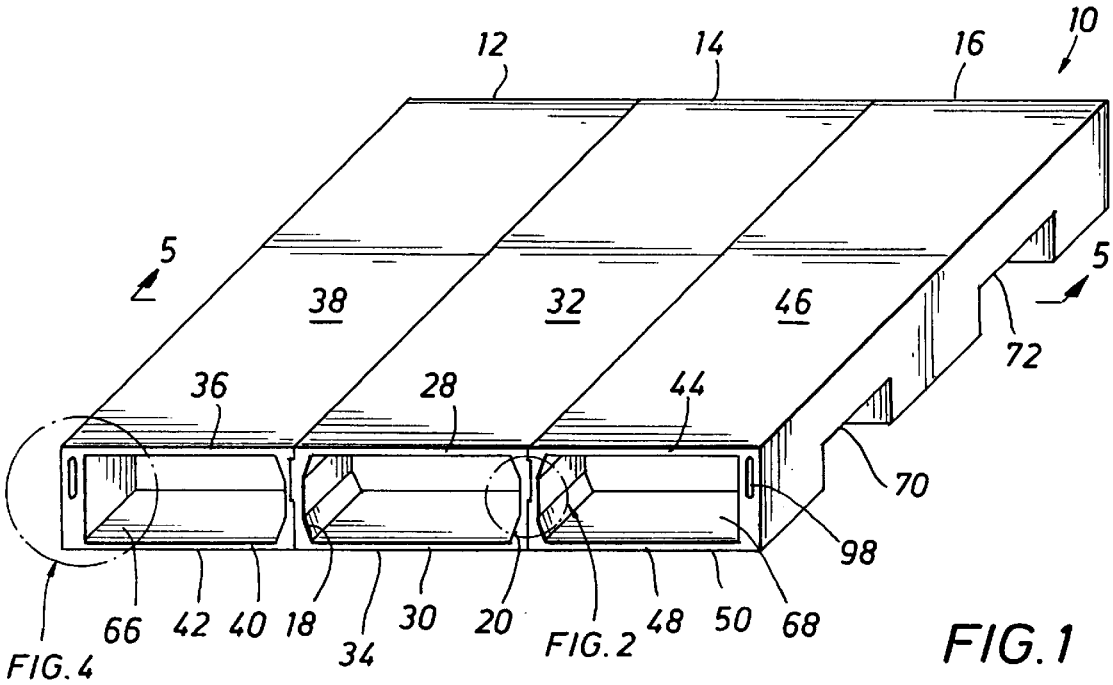
FIG. 1
FIG. 2
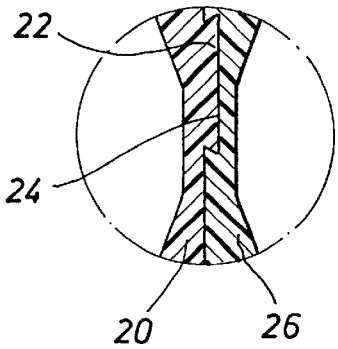
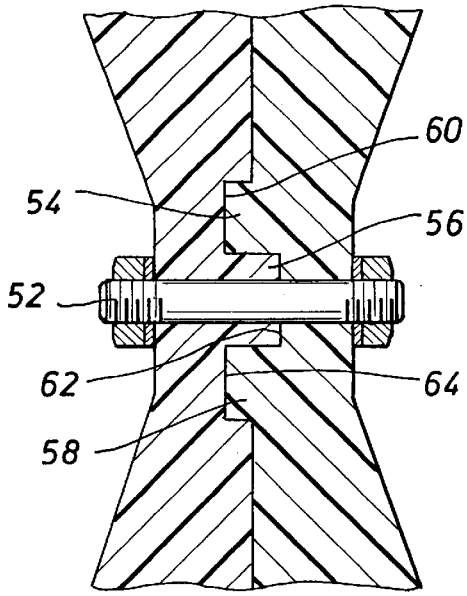
FIG. 3

FIG. 4
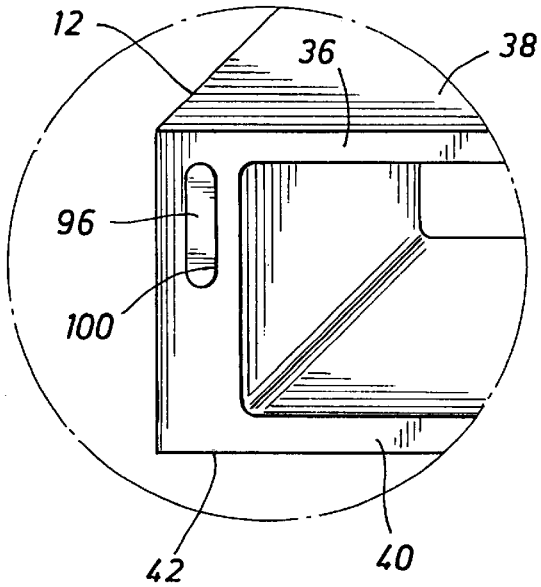
FIG. 5
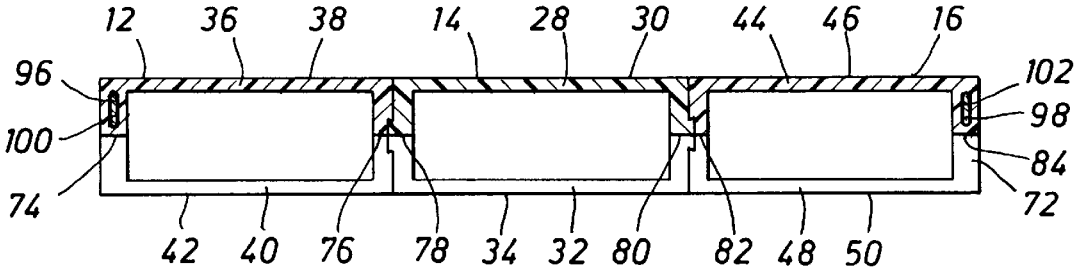
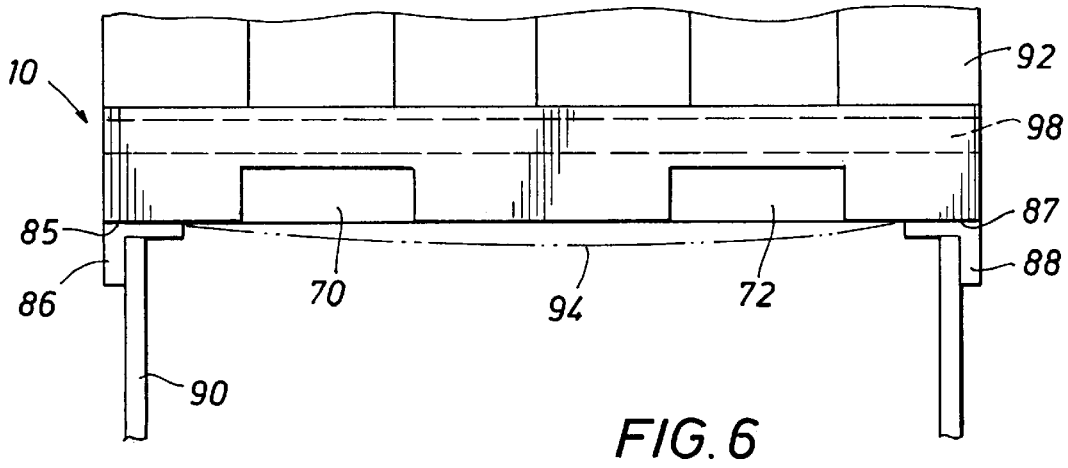
FIG. 6

REINFORCED PLASTIC PALLET

BACKGROUND OF THE INVENTION

1. Field of the Invention

This invention relates generally to pallets on which articles are stacked or assembled for volume handling by fork-lift trucks to enable handling and shipment of the articles at minimal labor and handling costs. More specifically, the present invention relates to plastic pallets which are constructed from virgin or reclaimed or recycled plastic materials and which have wear and damage resistance exceeding that of conventional pallets constructed of wood. Even more specifically, the present invention concerns plastic pallets composed of virgin, reclaimed or recycled plastic materials and which incorporate strategically located reinforcement to provide for wear and damage resistance far exceeding that of conventional wood or plastic pallets.

2. Description of the Prior Art

Fork-lift pallets have been in wide use for many years to minimize the cost of products or articles that can be stacked or otherwise secured on them to thus enable large volumes or products or articles to be handled simultaneously and to be handled in mechanized fashion so as to minimize labor costs. Historically, fork-lift pallets have been constructed of wood, having a plurality of parallel stringers on which are nailed or otherwise secured one or more structural members defining a pallet platform. The pallet platform can be composed of multiple wood strips or unitary wood panels, such as plywood panels, to provide a generally planar support surface on which the goods or articles are appropriately arranged or stacked. The parallel stringers raise the product support platform above a floor surface and thereby permit the forks of a fork-lift truck to be insurted within spaces defined between the stringers. This enables a fork-lift truck to lift and move the pallet with all of its articles as a unit or package. Typically, the pallet will remain with the products or articles until such time as the articles are removed from the pallet for further handling, for use or for distribution.

Even though pallets are typically of low cost, nevertheless they are sufficiently costly that they are used many times for shipment of products before they become sufficiently worn or damaged that replacement is necessary. Although wood has historically been a low cost commodity, thus enabling pallets to be manufactured of wood at low cost, of late, the cost of wood for products such as pallets has significantly increased, thus causing pallet manufacturers to seek other sources for materials. Pallets have been constructed of extruded or formed metal such as steel or aluminum. Pallets have also been constructed of molded or extruded plastic materials, including virgin plastic material or plastic material that has been recycled or reclaimed from waste.

A significant volume of waste plastic material is, at the present time, disposed of in landfills and is seen as a viable source of raw plastic material that can be prepared and utilized for the manufacture of simple products such as pallets, structural materials for buildings, railroad ties, etc. Use of these materials, which would otherwise constitute waste and require this disposition at significant expense, is seen as significant from the standpoint of industrial and government controlled economics. Moreover, products manufactured from plastic material whether virgin or reclaimed plastic material, have been found to have considerable wear resistance as well as resistance to damage by water or other environmental materials. Thus, plastic material, especially reclaimed plastic material, because of its abundance and its detriment to the environment and because of the present day cost of its handling and disposal, is seen as a viable source of material for pallet manufacture.

Pallets that are constructed of plastic material, whether virgin or reclaimed plastic material, have been found to have problems which the present invention effectively addresses. Plastic pallets manufactured at the present time are made by either injection molding or made by screwing, nailing or otherwise fastening plastic profiles in somewhat similar fashion to the manufacture of wood pallets. In both the injection moulding or assembling of plastic profiles, the costs are much higher than the cost of their wood counterparts, therefore making plastic pallets somewhat uneconomical as compared to pallets composed of conventional wood structure. Most of the plastic pallets that are currently produced are not "rackable" due to the plastic bending when located in a rack and under load. This pallet bending or yielding phenomenon is known as "creep" where the plastic under load will bend, thereby allowing the pallet to dislodge from a rack on which it rests since the pallet is supported on the rack only by resting on its edges. Accordingly, it is considered desirable to provide a novel pallet construction wherein the pallet or it components are constructed largely of molded or extruded plastic material and yet are structurally reinforced by internal structural elements that are preferably composed of metal, but which can be composed of wood or plastic materials when sufficient strength is afforded thereby.

SUMMARY OF THE INVENTION

It is a principal feature of the present invention to provide a novel pallet construction which is composed largely of plastic material in which is structurally reinforced by internal structural elements to provide the pallet construction with significant resistance to wear or damage;

It is another feature of the present invention to provide a novel pallet construction which is composed of a plurality of interlocked individually extruded tubular plastic elements;

It is an even further feature of the present invention to provide a novel pallet construction having a plurality of interlocked tubular pallet sections wherein at least some of the pallet sections are reinforced by an elongated reinforcement member so that the resulting pallet construction is reinforced against the development of a "creep" phenomena to thereby enable the pallet to be rackable for extended periods under loaded conditions;

It is also a feature of the present invention to provide a novel pallet construction having a plurality of mechanically interlocked tubular pallet sections which are designed to permit insertion of the forks of a fork-lift truck into fork receptacles from any selected side of the pallet construction.

It is an even further feature of the present invention to provide a novel pallet construction incorporating a plurality of interconnected tubular pallet components each constructed of plastic material, wherein at least some of the tubular elements defined internal elongate reinforcement cavities, enabling reinforcement bars constructed of metal or any other suitable material to be inserted within the reinforcement cavities to enhance the structural integrity of the resulting pallet construction; and It is also a feature of the present invention to provide a novel pallet construction incorporating a plurality of extruded tubular elements composed of plastic material in which are provided respectively dovetails or dovetail grooves to permit mechanically interlocked assembly thereof.

Briefly the various objects and features of the present invention are realized through the provision of a pallet construction composed largely of plastic material and being structurally enhanced to minimize the potential for creep of the plastic material to thus enable the resulting pallet to maintain a stackable geometric configuration even when positioned on racks for extended periods of time under load. The pallet construction is manufactured by initially moulding or extruding elongate, preferably tubular pallet sections, each composed of plastic material. These pallet sections are of generally rectangular cross-sectional configuration and define upper and lower substantially planar surface segments that enable the pallet to be supported by a rack structure or supported on a flat surface such as a floor, and with substantially flat upper surfaces of the resulting pallet being sufficiently designed for stacking of goods or articles in typical fashion. A central tubular pallet section is formed to define dovetails or dovetail grooves on respective side portions thereof These dovetails or dovetail grooves are adapted for mechanically interlocking relation with corresponding dovetails or dovetail grooves defined on two tubular sections which define outer edges of the resulting pallet. In addition to the mechanically interlocked assembly of the tubular pallet sections, the pallet sections may be individually welded or glued so that the interconnected tubular sections define an integral pallet structure. The two pallet sections that are intended to define stackable pallet edges of the pallet structure are extruded or otherwise formed in a manner defining an elongate internal reinforcement cavity. An elongate reinforcement member such as a steel reinforcement bar or a reinforcement member constructed of any other suitable material such as a structural plastic material, aluminium, wood, etc. is inserted into each of the elongate internal reinforcement cavities. This feature enables strategic internal reinforcement of the resulting pallet so that the pallet load is supported by reinforcing members in regions that effectively minimize the potential for creep of the plastic material The elongate reinforcement bars may be secured within the respective reinforcement cavities by glue, bonding material or simply by frictional retention. Although the adjacent tubular pallet sections may be interconnected by dovetail joints, it is also with in the spirit and scope of the present invention to interconnect the adjacent pallet sections by means of any suitable fasteners such as screws, bolts, etc. which may be utilized in conjunction with welding, gluing or bolting to thereby ensure that the pallet sections remain in integral assembly throughout the service life of the pallet structure. The pallet sections may be provided with any suitable joint geometry that will enable adjacent pallet sections to be accurately aligned and structurally connected with respect to one another so that the upper and lower support surfaces of the pallet sections will be disposed in substantially co-planar relation.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an isometric illustration of a reinforced plastic pallet that is constructed in accordance with principles of the present invention;

FIG. 2 is a fragmentary end view of the pallet construction of FIG. 1 showing dovetail interlocking of adjacent tubular pallet sections;

FIG. 3 is a fragmentary sectional view similar to that of FIG. 2 and showing an alternative embodiment for mechanical interlocking of pallet components and further showing mechanical fasteners such as bolts being utilized to secure or assist in securing adjacent pallet components in integral assembly;

FIG. 4 is another fragmentary end view of the pallet structure of FIG. 1 showing the presence of a reinforcing bar within an elongate internal reinforcing cavity of each of the outer tubular pallet sections for reinforcing opposite side portions of the pallet to prevent creep of the plastic material when the pallet is positioned on a rack for an extended period of time under load;

FIG. 5 is a sectional view taken along line 5—5 of FIG. 1 and showing one of the fork-lift slot structures defined by cut-away sections of the pallet; and FIG. 6 is an elevational view showing the reinforced pallet of the present invention being supported by a pallet storage rack and, by way of broken lines, showing orientation of internal reinforcing bars to prevent bending of the pallet under load by plastic creep when the loaded pallet is supported for an extended period of time by a storage rack.

DETAILED DESCRIPTION OF PREFERRED EMBODIMENT

Referring now to the drawings and first to FIG. 1, a reinforced plastic pallet being constructed in accordance with the principles of the present invention and representing the preferred embodiment is illustrated generally at 10. The pallet structure is shown to be composed of three single cavity tubular plastic elements or sections 12, 14 and 16, which are mechanically interconnected and which define a pallet structure of integral construction. The outer tubular elements 12 and 16 are essentially mirror images of one another and therefore may be defined by tubular element having identical cross-sectional geometry. The central tubular element will be of differing cross-sectional geometry and will be designed to establish mechanically interlocking relation with each of the outer tubular elements. Although three pallet tubes or sections are shown, such is not intended to limit the spirit and scope of the present invention because any suitable number of interconnected plastic tubes may be utilized. Also, plastic elements or sections in the form of structures other than tubular elements may also be utilized within the spirit and scope of the present invention. It is only necessary that the sections that are assembled to form a pallet structure be capable of mechanical interconnection so that the resulting pallet will be of sufficient structural integrity to support objects or articles of predetermined maximum weight and that the pallet be capable of being supported on a floor surface or a pallet rack and that the pallet present a substantially planar upper surface on which articles may be stacked.

As shown in FIG. 1, the central tubular element or section 14 defines side walls 18 and 20 which each define external dove tail joint elements or ribs 22 which are each received within corresponding dove-tail slots 24 of inner side walls 26 of the outer tubular pallet sections 12 and 16 as shown in detail in the fragmentary end view of FIG. 2. Though dove-tail slot connection of the pallet sections is preferred, as shown in FIGS. 1 and 2, it should be born in mind that mechanically interlocking features of the inner and outer tubular pallet sections of any other suitable design may be utilized without departing from the spirit and scope of the present invention For example, an alternative embodiment is shown in the fragmentary end view of FIG. 3 which show interlocking geometry of rectangular cross-sectional configuration being employed to establish interlocking between the pallet sections.

The dove-tail or rectangular interlocking joint between the pallet sections may be secured or made integral during assembly of the pallet sections by introducing a suitable cement or bonding agent in the joint, so that the resulting joint is of permanent and the pallet sections form an integral pallet unit. Also the pallet section joints may be heat or chemically fused during assembly to prevent inadvertent separation of the pallet sections during use.

The central pallet section 14 defines upper and lower walls 28 and 30 which are disposed in substantially parallel relation. The upper wall 28 defines an upwardly facing planar surface 32 which provides support for products or articles that are stacked on the pallet. The lower wall 30 defines a downwardly facing planar surface 34 which permits the pallet to rest on a flat surface such as the floor of a building, a loading dock, etc.

The outer pallet section 12 likewise defines an upper wall 36 defining an upwardly facing planar surface 38 which, when the pallet sections 12 and 14 are in interlocked assembly, is substantially coplanar with the upper wall 36 and planar surface 32 of the central pallet section 14. Likewise, the pallet section 12 defines a lower wall 40 defining a downwardly facing planar surface 42. As mentioned above, the outer tubular pallet section 16 is essentially a mirror image of the pallet section 12 and defines an upper wall 44 defining an upwardly facing planar surface 46 and a lower wall 48 defining a downwardly facing planar surface 50. When all of the pallet sections 12, 14 and 16 are in assembly, the upper surfaces 30, 38 and 46 will be disposed in substantially co-planar relation and the lower surfaces 34, 42 and 50 will also be disposed in substantially co-planar relation.

Although the pallet sections may be cemented or bonded to permanently secure the dovetail joints or rectangular interlocking joints as the case may be, any suitable fasteners, such as bolts, screws or the like may be used to secure the pallet sections in immovable relation with each other. As shown in FIG. 3, for example, the interlocking pallet sections are additionally secured by fastener bolts 52. The fastener bolts 52 serve to secure the elongate ribs 54, 56 and 58 of the joint structure within respective elongate slots 60, 62 and 64 as shown.

To enable fork-lift handling of the pallet, the generally rectangular openings 66 and 68 are designed and sized to accept the forks of a fork-lift truck lifting mechanism., thus permitting lifting of the pallet from each end thereof. Additionally, the pallet sections are each formed to define downwardly facing rectangular slots 70 and 72 which are disposed in registry when the pallet sections are assembled, so as to define elongate fork-lift slots that extend from side to side of the pallet structure. This feature permits the pallet to also be lifted from either of its sides. With respect to the fork-lift slots 70 and 72, it should be born in mind that the fork-lift slots are defined by cut-away portions of each of the tubular pallet sections 12, 14 and 16. These cut-away sections are more clearly evident from FIG. 5, which is a sectional view taken along line 5—5 of FIG. 1. When cut away in this manner, the side walls of the respective tubular sections of the pallet structure define multiple downwardly facing wall surfaces shown at 74, 76, 78, 80, 82 and 84. These downwardly facing wall surface segments are disposed for pallet supporting contact with the forks of a fork-lift truck and the respective side walls of the pallet sections are of sufficient structural integrity to support the weight of the pallet and its contents when loaded to its maximum allowable weight.

As mentioned above, pallets constructed of plastic material tend to bend under load due to the creep phenomenon that is prevalent when plastic materials are placed under load for extended periods of time. When a pallet and its load is supported on a rack, it will be essentially supported by front and rear rack beams or supports 86 and 88 of a rack structure 90 such as shown in FIG. 6. As shown in FIG. 6, the pallet is supported only on its edges 85 and 87 by the rack supports 86 and 88. With the central portion of the pallet essentially unsupported, the load 92 of the products or articles will act downwardly on the pallet structure, thus permitting the unsupported central portion of the pallet to bend and to be come deformed by the creep phenomenon described above. In time the load will cause virtually all plastic materials, whether virgin plastic or reclaimed plastic to become permanently deformed as shown by broken lines at 94. This bending phenomenon will cause the supported edges of the pallet to slide inwardly so as to slide off of the supports of the rack. When this occurs, the thus deformed pallet will fall. This condition is exacerbated by additional weight if the pallets are stacked one above the other.

To overcome the disadvantage of plastic creep as described above and to render the pallets of the present invention to a condition known as "rackable", the pallets are structurally reinforced at the front and rear edges by structural reinforcing elements 96 and 98 which are located within the front and rear wall structure of the pallet. The outer tubular elements or sections 12 and 16 are typically extruded from plastic material. During extrusion, the pallet sections are extruded in such manner as to define an internal reinforcing slot 100 or 102 which extends from side to side as shown in broken line in FIG. 6. After the pallet has cooled and solidified, an elongate reinforcing bar 90 or 98, as the case may be, is inserted within respective internal slots 100 and 102 and secured therein by cementing, bonding by friction or by any other suitable means. The reinforcing bars are preferably composed of steel and may be of any suitable cross-sectional configuration that is appropriate to provide the front and rear support edges of the pallet with efficient support and resistance to plastic creep. The reinforcing bars may also be constructed of any other suitable metal or non-metal material such as aluminum, another plastic having enhanced structural integrity, wood members or the like. The structural members may be introduced into the pallet structure during the extrusion process if desired, to minimize assembly of the reinforcing bars within the pallet wall structure. Also, if desired, other wall structures of the pallet may be similarly reinforced by reinforcing bars in the same manner.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A method for manufacture of a reinforced plastic pallet, comprising:

(a) forming a plurality of tubular pallet sections each being of generally rectangular cross-sectional configuration and being composed of plastic material and having spaced upper and lower walls and spaced side walls, at least one of said side walls of each of said tubular pallet sections having interlocking elements, at least two of said side walls of said pallet sections being outer side walls each defining at least one reinforcing receptacle extending substantially the length of the respective outer side wall;

(b) inserting elongate reinforcing elements into each of said reinforcing receptacles; and (c) establishing interlocking assembly of said interlocking elements for securing side walls of said plurality of pallet sections in interlocked assembly.

2. The method of claim 1, comprising:

(a) during said forming, establishing a pair of spaced generally parallel side walls interconnected by a top wall and forming said interlocking elements being located on said side walls; and (b) positioning at least two of said pallet sections in side-by-side relation and moving said interlocking elements of said side walls into said establishing interlocking assembly.

3. The method of claim 1, comprising:

(a) after establishing interlocking assembly of said interlocking elements, securing said interlocking elements in permanent and immovable assembly.

4. The method of claim 3, comprising:

(a) bonding said interlocking elements.

5. The method of claim 3, comprising:

(a) thermal welding said interlocking elements.

6. The method of claim 1, comprising:

(a) permanently securing said elongate reinforcing elements within said reinforcing receptacles.

7. The method of claim 1, comprising:

(a) Applying bonding or adhesive material to said elongate reinforcing elements for permanently securing said elongate reinforcing elements within said reinforcing receptacles.

8. The method of claim 1, comprising:

(a) Mechanically fastening said plurality of pallet sections in substantially immovable assembly.

9. A reinforced plastic pallet, comprising:

(a) a plurality of tubular pallet sections each being of generally rectangular cross-sectional configuration and being composed of plastic material and having spaced upper and lower walls and spaced side walls, at least one of said side walls of each of said tubular pallet sections having interlocking elements, at least two of said pallet sections respectively defining front and rear pallet edges and each defining at least one internal reinforcing receptacle located adjacent said front and rear pallet edges and extending substantially the length thereof; and (b) at least two elongate reinforcing elements being located respectively within said internal reinforcing receptacles of said at least two of said pallet sections and being oriented for reinforcing said front and rear pallet edges to minimize bending of said reinforced plastic pallet when supported under load.

10. The reinforced plastic pallet of claim 9, comprising:

(a) said interlocking elements being a dove-tail and corresponding dove-tail groove defined by adjacent pallet sections and being disposed in mechanically interlocked assembly for securing said tubular pallet sections in assembly.

11. The reinforced plastic pallet of claim 9, comprising:

(a) each of said pallet sections defining a planar top wall and said spaced side walls having substantially parallel relation and being oriented in substantially perpendicular relation with said planar top wall; and (b) said side walls of adjacent pallet sections defining said interlocking elements; and (c) said interlocking elements securing said side walls of adjacent pallet sections in interlocked assembly and orienting said planar top walls of said pallet sections in substantially co-planar relation.

12. The reinforced plastic pallet of claim 11, comprising:

(a) a first outer pallet section defining a front pallet wall;

(b) a second outer pallet section defining a rear pallet wall;

(c) said reinforcing receptacles being defined within said front and rear pallet walls; and (d) said reinforced plastic pallet defining a pair of spaced downwardly facing fork-lift slots each intersecting said front and rear pallet walls.

13. The reinforced plastic pallet of claim 12, comprising:

(a) each of said pallet sections defining spaced side walls; and (b) said pair of spaced downwardly facing fork-lift slots each intersecting each of said spaced side walls.

14. The reinforced plastic pallet of claim 9, comprising:

(a) each of said tubular pallet sections being of integral construction and said top and bottom walls being of planar configuration and being disposed in substantially parallel relation, said spaced side walls being disposed in substantially parallel relation and being oriented in substantially perpendicular relation with said planar top wall and said planar bottom wall;

(b) said side walls of adjacent pallet sections defining said interlocking elements; and (c) said interlocking elements securing said side walls of adjacent pallet sections in interlocked assembly and orienting said planar top walls of each of said pallet sections in substantially co-planar relation and orienting said planar bottom walls of each of said pallet sections in substantially co-planar relation.

15. The reinforced plastic pallet of claim 14, comprising:

(a) said side walls of each of said pallet sections defining a pair of spaced downwardly facing fork-lift slots each intersecting each of said spaced pallet walls; and (b) said downwardly facing fork-lift slots each intersecting said planar bottom walls of each of said pallet sections.

16. The reinforced plastic pallet of claim 15, comprising:

each of said side walls of said pallet sections at said intersection thereof by said downwardly facing fork-lift slots defining support surface segments for engagement by the lifting forks of a fork-lift truck and serving to distribute the pallet load to the lifting forks.

* * * * *